US009818570B2

(12) United States Patent
Alvarado et al.

(10) Patent No.: US 9,818,570 B2
(45) Date of Patent: Nov. 14, 2017

(54) ION SOURCE FOR MULTIPLE CHARGED SPECIES

(71) Applicant: Varian Semiconductor Equipment Associates, Inc., Gloucester, MA (US)

(72) Inventors: Daniel Alvarado, Methuen, MA (US); Klaus Becker, Kensington, NH (US); David Ackerman, Gloucester, MA (US)

(73) Assignee: Varian Semiconductor Equipment Associates, Inc., Gloucester, MA (US)

( * ) Notice: Subject to any disclaimer, the term of this patent is extended or adjusted under 35 U.S.C. 154(b) by 60 days.

(21) Appl. No.: 14/972,412

(22) Filed: Dec. 17, 2015

(65) Prior Publication Data

US 2017/0117113 A1 Apr. 27, 2017

Related U.S. Application Data

(60) Provisional application No. 62/245,567, filed on Oct. 23, 2015.

(51) Int. Cl.

| | |
|---|---|
| ***H01J 1/22*** | (2006.01) |
| ***H01J 27/20*** | (2006.01) |
| ***H01J 27/02*** | (2006.01) |
| ***H05H 1/03*** | (2006.01) |

(52) U.S. Cl.

CPC ..... *H01J 27/205* (2013.01); *H01J 1/22* (2013.01); *H01J 27/024* (2013.01); *H05H 1/03* (2013.01)

(58) Field of Classification Search

None

See application file for complete search history.

(56) References Cited

U.S. PATENT DOCUMENTS

| | | | | |
|---|---|---|---|---|
| 7,586,109 | B2 * | 9/2009 | Perel | H01J 37/08 250/423 R |
| 8,330,127 | B2 * | 12/2012 | Low | H01J 27/022 250/492.1 |
| 8,759,788 | B1 * | 6/2014 | Bassom | H01J 37/08 250/423 R |
| 8,841,631 | B1 * | 9/2014 | Sinclair | H01J 37/1477 250/396 ML |

(Continued)

FOREIGN PATENT DOCUMENTS

KR 10-1385678 B1 4/2014

OTHER PUBLICATIONS

International Search Report and Written Opinion dated Dec. 14, 2016 in corresponding PCT application No. PCT/US2016/053361.

*Primary Examiner* — Douglas W Owens
*Assistant Examiner* — Srinivas Sathiraju
(74) *Attorney, Agent, or Firm* — Nields, Lemack & Frame, LLC

(57) ABSTRACT

An indirectly heated cathode (IHC) ion source having improved life is disclosed. The IHC ion source comprises a chamber having a cathode and a repeller on opposite ends of the ion source. Biased electrodes are disposed on one or more sides of the ion source. The bias voltage applied to at least one of the cathode, the repeller and the electrodes, relative to the chamber, is varied over time. In certain embodiments, the voltage applied to the electrodes may begin at an initial positive voltage. Over time, this voltage may be reduced, while still maintaining the target ion beam current. Advantageously, the life of the cathode is improved using this technique.

20 Claims, 4 Drawing Sheets

(56) References Cited

U.S. PATENT DOCUMENTS 8,883,620 B1 * 11/2014 Sinha ..... H01J 27/02 250/424
8,933,630 B2 * 1/2015 Lin ..... H01J 37/08 250/423 R
8,937,003 B2 * 1/2015 Perel ..... C23C 14/48 250/423 R
9,064,795 B2 * 6/2015 Koo ..... C23C 14/48
9,093,372 B2 * 7/2015 Koo ..... C23C 14/48
9,530,615 B2 * 12/2016 Kurunczi ..... B08B 7/0021
2006/0066248 A1 3/2006 Chistyakov
2007/0107841 A1 * 5/2007 Horsky ..... H01J 27/205 156/345.4
2007/0278417 A1 * 12/2007 Horsky ..... H01J 27/205 250/427
2008/0179545 A1 * 7/2008 Perel ..... H01J 37/08 250/492.21
2009/0242793 A1 * 10/2009 Low ..... H01J 27/022 250/424
2012/0101742 A1 * 4/2012 Low ..... H01J 37/08 702/34
2012/0235058 A1 * 9/2012 Sinha ..... H01J 37/08 250/424
2013/0020940 A1 * 1/2013 Becker ..... H01J 27/022 315/111.81
2013/0072008 A1 * 3/2013 Perel ..... C23C 14/48 438/514
2013/0081761 A1 4/2013 Sawada
2013/0260543 A1 * 10/2013 Koo ..... C23C 14/48 438/515
2013/0260544 A1 * 10/2013 Koo ..... C23C 14/48 438/527
2014/0061501 A1 * 3/2014 Sinha ..... H01J 37/08 250/424
2014/0322902 A1 * 10/2014 Sinha ..... H01J 27/02 438/514
2014/0329377 A1 * 11/2014 Heiderman ..... H01L 21/265 438/514
2015/0034837 A1 * 2/2015 Koo ..... H01J 27/205 250/424
2015/0101634 A1 * 4/2015 Leavitt ..... H01J 27/022 134/1.1
2015/0179455 A1 * 6/2015 Koo ..... C23C 14/48 438/527
2015/0357152 A1 * 12/2015 Jones ..... H01J 37/08 222/3

* cited by examiner

ION SOURCE FOR MULTIPLE CHARGED SPECIES

This application claims priority of U.S. Provisional Patent Application 62/245,567, filed Oct. 23, 2015, the disclosure of which is incorporated herein by reference in its entirety.

FIELD

Embodiments of the present disclosure relate to an indirectly heated cathode (IHC) ion source, and more particularly, an IHC ion source with variable electrode voltages to improve the life of the IHC ion source.

BACKGROUND

Indirectly heated cathode (IHC) ion sources operate by supplying a current to a filament disposed behind a cathode. The filament emits thermionic electrons, which are accelerated toward and heat the cathode, in turn causing the cathode to emit electrons into the chamber of the ion source. The cathode is disposed at one end of a chamber. A repeller is typically disposed on the end of the chamber opposite the cathode. The repeller may be biased so as to repel the electrons, directing them back toward the center of the chamber. In some embodiments, a magnetic field is used to further confine the electrons within the chamber.

In certain embodiments, electrodes are also disposed on one or more sides of the chamber. These electrodes may be positively or negatively biased so as to control the position of ions and electrons, so as to increase the ion density near the center of the chamber. An extraction aperture is disposed along another side, proximate the center of the chamber, through which the ions may be extracted.

One issue associated with IHC ion sources is that the cathode may have a limited lifetime. The cathode is subjected to bombardment from electrons on its back surface, and by positively charged ions on its front surface. This bombardment results in sputtering, which causes erosion of the cathode. In many embodiments, the life of the IHC ion source is dictated by the life of the cathode.

Therefore, an IHC ion source that can increase the life of the cathode may be beneficial. Further, it would be advantageous if this apparatus maintained the desired beam current throughout the life of the IHC ion source.

SUMMARY

An IHC ion source having improved life is disclosed. The IHC ion source comprises a chamber having a cathode and a repeller on opposite ends of the ion source. Biased electrodes are disposed on one or more sides of the ion source. The bias voltage applied to at least one of the cathode, the repeller and the electrodes, relative to the chamber, is varied over time. In certain embodiments, the voltage applied to the electrodes may begin at an initial positive voltage. Over time, this voltage may be reduced, while still maintaining the target ion beam current. Advantageously, the life of the cathode is improved using this technique.

According to one embodiment, an indirectly heated cathode ion source is disclosed. The indirectly heated cathode ion source comprises a chamber into which a gas is introduced; a cathode disposed on one end of the chamber; a repeller disposed at an opposite end of the chamber; and at least one electrode disposed along a side of the chamber; wherein a voltage applied to at least one of the cathode, the repeller and the at least one electrode relative to the chamber varies over time. In certain embodiments, the voltage decreases over time. In certain embodiments, the ion source comprises a controller. In certain embodiments, the controller monitors hours of operation of the indirectly heated cathode ion source and determines the voltage to be applied based on hours of operation of the indirectly heated cathode ion source. In certain embodiments, the controller is in communication with a current measurement system, wherein the measurement system measures current of an ion beam extracted from the indirectly heated cathode ion source through an extraction aperture, and the controller adjusts the voltage to be applied based on measured current of the ion beam. In certain embodiments, at least one of the cathode, the repeller and the at least one electrode is initially formed with a front surface having a concave surface.

According to another embodiment, an indirectly heated cathode ion source is disclosed. The indirectly heated cathode ion source comprises a chamber into which a gas is introduced; a cathode disposed on one end of the chamber; a repeller disposed at an opposite end of the chamber; and at least one electrode disposed along a side of the chamber; wherein a voltage applied to the at least one electrode decreases over time. In certain embodiments, the ion source further comprises a second electrode on a side opposite the at least one electrode, where the second electrode is electrically connected to the chamber. In certain embodiments, the cathode and the repeller are negatively biased relative to the chamber and the at least one electrode is initially positively biased relative to the chamber. In certain embodiments, the indirectly heated cathode ion source comprises a controller, and the controller decreases the voltage by a first rate during a burn-in phase and decreases the voltage by a second rate during an operational phase, wherein the first rate is greater than the second rate.

According to another embodiment, an indirectly heated cathode ion source is disclosed. The indirectly heated cathode ion source comprises a chamber; a cathode disposed on one end of the chamber, in communication with a cathode power supply; a repeller disposed on an opposite end of the chamber, in communication with a repeller power supply; an electrode disposed within the chamber and on a side of the chamber, in communication with an electrode power supply; an extraction aperture disposed on another side of the chamber; and a controller, in communication with at least one of the cathode power supply, the repeller power supply and the electrode power supply, wherein the controller modifies a voltage applied to one of the cathode, the repeller and the electrode relative to the chamber over time. In certain embodiments, the cathode power supply and the repeller power supply are one power supply.

BRIEF DESCRIPTION OF THE FIGURES

For a better understanding of the present disclosure, reference is made to the accompanying drawings, which are incorporated herein by reference and in which.

DETAILED DESCRIPTION

As described above, indirectly heated cathode ion sources may be susceptible to shortened life due to the effect of sputtering, especially on the cathode and the repeller. Typically, over time, one or both of these components fail, often when a hole develops through the component.

Figure 1:
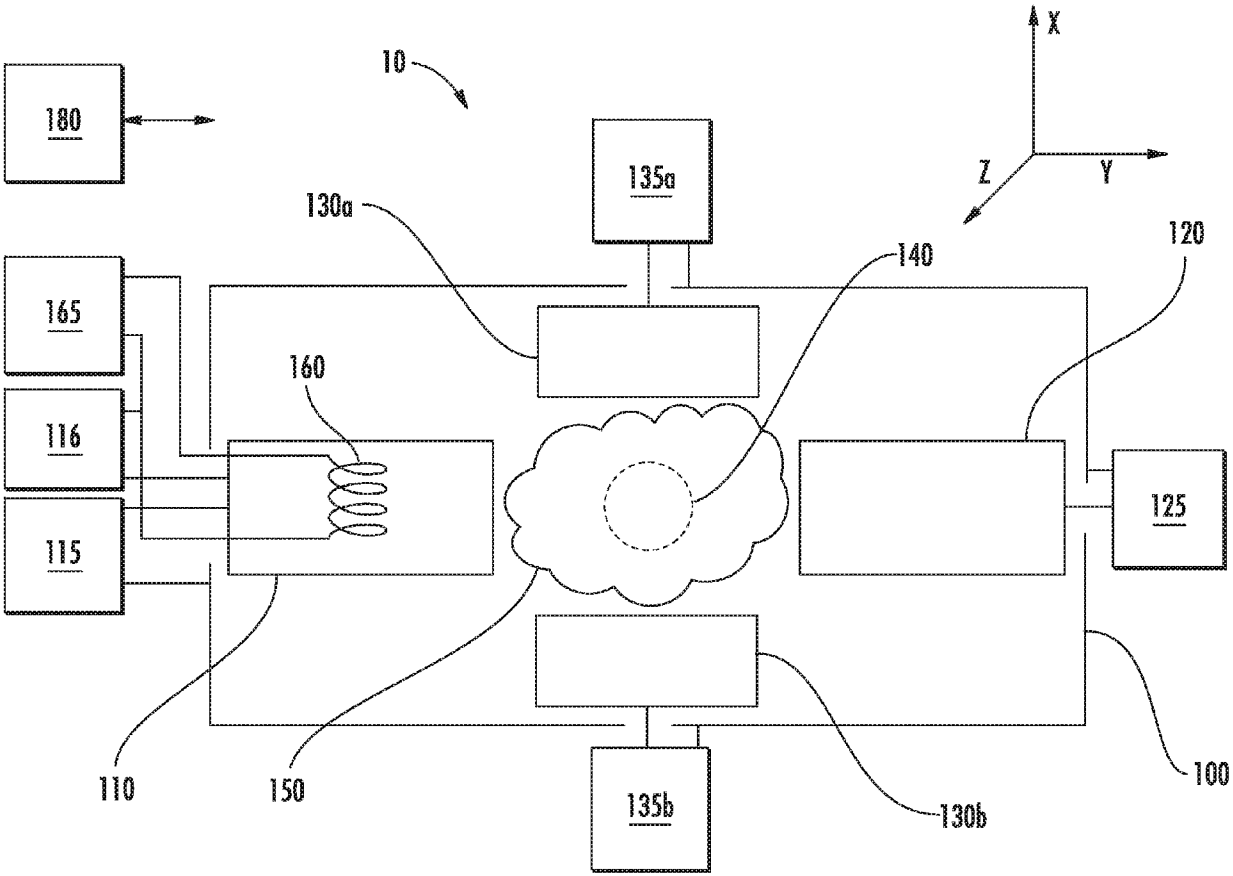
FIG. 1 is an ion source in accordance with one embodiment.

FIG. 1 shows an IHC ion source 10 that overcomes these issues. The IHC ion source 10 includes a chamber 100, having two opposite ends, and sides connecting to these ends. The chamber may be constructed of an electrically conductive material. A cathode 110 is disposed in the chamber 100 at one of the ends of the chamber 100. This cathode 110 is in communication with a cathode power supply 115, which serves to bias the cathode 110 with respect to the chamber 100. In certain embodiments, the cathode power supply 115 may negatively bias the cathode 110 relative to the chamber 100. For example, the cathode power supply 115 may have an output in the range of 0 to −150V, although other voltages may be used. In certain embodiments, the cathode 110 is biased at between 0 and −40V relative to the chamber 100. A filament 160 is disposed behind the cathode 110. The filament 160 is in communication with a filament power supply 165. The filament power supply 165 is configured to pass a current through the filament 160, such that the filament 160 emits thermionic electrons. Cathode bias power supply 116 biases filament 160 negatively relative to the cathode 110, so these thermionic electrons are accelerated from the filament 160 toward the cathode 110 and heat the cathode 110 when they strike the back surface of cathode 110. The cathode bias power supply 116 may bias the filament 160 so that it has a voltage that is between, for example, 300V to 600V more negative than the voltage of the cathode 110. The cathode 110 then emits thermionic electrons on its front surface into chamber 100. This technique may also be known as "electron beam heating".

Thus, the filament power supply 165 supplies a current to the filament 160. The cathode bias power supply 116 biases the filament 160 so that it is more negative than the cathode 110, so that electrons are attracted toward the cathode 110 from the filament 160. Finally, the cathode power supply 115 biases the cathode 110 more negatively than the chamber 100.

A repeller 120 is disposed in the chamber 100 on the end of the chamber 100 opposite the cathode 110. The repeller 120 may be in communication with repeller power supply 125. As the name suggests, the repeller 120 serves to repel the electrons emitted from the cathode 110 back toward the center of the chamber 100. For example, the repeller 120 may be biased at a negative voltage relative to the chamber 100 to repel the electrons. Like the cathode power supply 115, the repeller power supply 125 may negatively bias the repeller 120 relative to the chamber 100. For example, the repeller power supply 125 may have an output in the range of 0 to −150V, although other voltages may be used. In certain embodiments, the repeller 120 is biased at between 0 and −40V relative to the chamber 100.

In certain embodiments, the cathode 110 and the repeller 120 may be connected to a common power supply. Thus, in this embodiment, the cathode power supply 115 and repeller power supply 125 are the same power supply.

Although not shown, in certain embodiments, a magnetic field is generated in the chamber 100. This magnetic field is intended to confine the electrons along one direction. For example, electrons may be confined in a column that is parallel to the direction from the cathode 110 to the repeller 120 (i.e. the y direction).

Electrodes 130*a*, 130*b* may be disposed on sides of the chamber 100, such that the electrodes 130*a*, 130*b* are within the chamber 100. The electrodes 130*a*, 130*b* may be biased by a power supply. In certain embodiments, the electrodes 130*a*, 130*b* may be in communication with a common power supply. However, in other embodiments, to allow maximum flexibility and ability to tune the output of the IHC ion source 10, the electrodes 130*a*, 130*b* may each be in communication with a respective electrode power supply 135*a*, 135*b*.

Like cathode power supply 115 and repeller power supply 125, the electrode power supplies 135*a*, 135*b* serve to bias the electrodes relative to the chamber 100. In certain embodiments, the electrode power supplies 135*a*, 135*b* may bias the electrodes 130*a*, 130*b* positively or negatively relative to the chamber 100. For example, the electrode power supplies 135*a*, 135*b* may initially bias at least one of the electrodes 130*a*, 130*b* at a voltage of between 0 and 150 volts relative to the chamber. In certain embodiments, at least one of the electrodes 130*a*, 130*b* may be initially biased at between 60 and 150 volts relative to the chamber. In other embodiments, one or both of the electrodes 130*a*, 130*b* may be electrically connected to the chamber 100, and therefore is at the same voltage as the chamber 100.

Each of the cathode 110, the repeller 120 and the electrodes 130*a*, 130*b* are made of an electrically conductive material, such as a metal.

Disposed on another side of the chamber 100 may be an extraction aperture 140. In FIG. 1, the extraction aperture 140 is disposed on a side that is parallel to the X-Y plane (parallel to the page). Further, while not shown, the IHC ion source 10 also comprises a gas inlet through which the gas to be ionized is introduced to the chamber.

A controller 180 may be in communication with one or more of the power supplies such that the voltage or current supplied by these power supplies may be modified. Further, in certain embodiments, the controller 180 may be in communication with a measurement system 200 (see FIG. 3), which monitors the extracted ion beam current. The controller 180 may adjust one or more power supplies over time. These adjustments may be based on hours of operation or based on the measured extracted ion beam current. The controller 180 may include a processing unit, such as a microcontroller, a personal computer, a special purpose controller, or another suitable processing unit. The controller 180 may also include a non-transitory storage element, such as a semiconductor memory, a magnetic memory, or another suitable memory. This non-transitory storage element may contain instructions and other data that allows the controller 180 to perform the functions described herein.

During operation, the filament power supply 165 passes a current through the filament 160, which causes the filament to emit thermionic electrons. These electrons strike the back surface of the cathode 110, which may be more positive than the filament 160, causing the cathode 110 to heat, which in turn causes the cathode 110 to emit electrons into the chamber 100. These electrons collide with the molecules of gas that are fed into the chamber 100 through the gas inlet. These collisions create ions, which form a plasma 150. The plasma 150 may be confined and manipulated by the electrical fields created by the cathode 110, the repeller 120, and the electrodes 130*a*, 130*b*. In certain embodiments, the plasma 150 is confined near the center of the chamber 100, proximate the extraction aperture 140.

Over time, the cathode 110, the repeller 120 and the electrodes 130*a*, 130*b* may be worn down due to the sputtering of the ions and electrons on these components. For example, FIG. 2 may represent the ion source of FIG. 1 after hours of operation. Cathode 110, repeller 120, and electrodes 130*a*, 130*b* have eroded, and each may now have a front surface that is a concave shape. Thus, the plasma 150 may grow as compared to its size in FIG. 1. This may result in a decrease in ion density and therefore, a corresponding decrease in extracted ion beam current.

In some cases, the current supplied to the filament 160 may be increased by the controller 180 to compensate for this decrease in plasma density. This causes the cathode 110 to heat to a higher temperature, emitting more electrons. In some cases, the potential difference between the filament 160 and the cathode 110 is changed, by varying the output of cathode bias power supply 116, changing the energy at which the electrons from the filament 160 strike the cathode 110. In certain cases, both of these techniques are used. However, these techniques, while successful in restoring the desired extracted ion beam current, may have deleterious effects on the life of the ion source.

Rather than modifying the current in the filament 160, or modifying the bias voltage between filament 160 and cathode 110, the present system adjusts the voltages applied to at least one of the cathode 110, the repeller 120 and the electrodes 130*a*, 130*b* relative to the chamber over time.

The controller 180 may modify these voltages in one of two ways. First, the controller 180 may modify the voltages based on hours of operation. For example, the controller 180 may include a table, formula, equation or other technique which associates a voltage with the current hours of operation. Further, the controller 180 may include a clock function allowing the controller 180 to track the amount of time that the IHC ion source 10 has been utilized. In other words, if the IHC ion source 10 has been in operation for 50 hours, the controller 180 may refer to a table or perform a calculation to determine the appropriate voltage to apply to the cathode 110, the repeller 120 and the electrodes 130*a*, 130*b*, based on this value. The controller 180 may change the voltage continuously, or may change the voltage in discrete steps. For example, the controller 180 may change the voltage after every N hours of operation.

Figure 3:
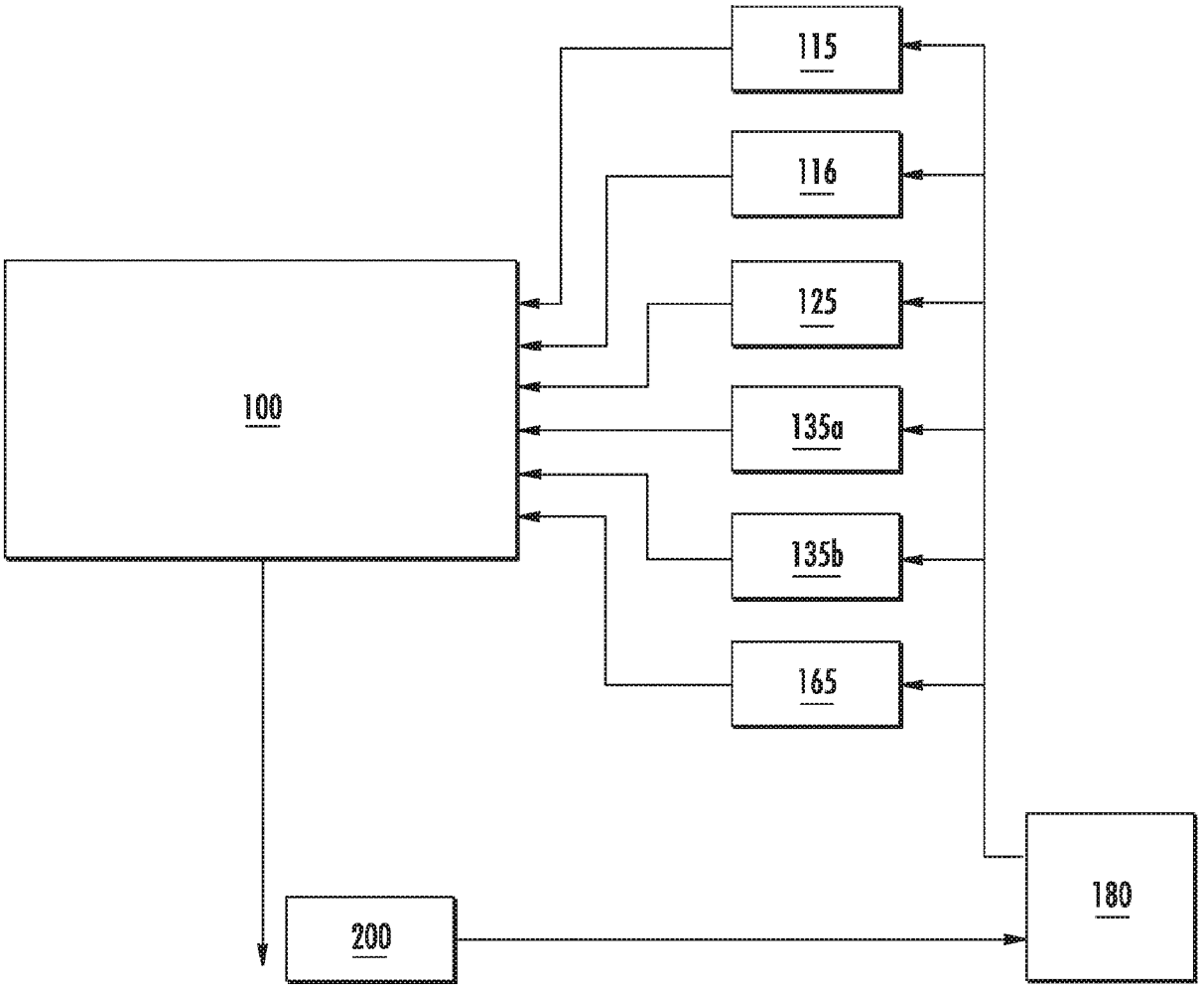
FIG. 3 is a representation of the control system according to one embodiment.

In another embodiment, the controller 180 may utilize closed loop feedback, as shown in FIG. 3. In this embodiment, a measurement system 200 is used to measure the extracted ion beam current. This measurement system 200 may include a Faraday cup or another suitable measuring device. The controller 180 may be in communication with this measurement system 200, such that the measured extracted ion beam current is available to the controller 180. Based on this measured value, the controller 180 may adjust one or more of the voltages applied to the cathode 110, the repeller 120 and the electrodes 130*a*, 130*b*. In this way, the controller 180 maintains a desired ion beam current by adjustment of voltages applied to the cathode 110, the repeller 120 and the electrodes 130*a*, 130*b*. This may be achieved by causing one of the power supplies to modify its output.

In one specific embodiment, the controller 180 may monitor hours of operation and adjust the voltage applied to electrode 130*a*, using electrode power supply 135*a*. In certain embodiments, the voltage applied to the electrode 130*a* may decrease over time. For example, the voltage may be a first value when the ion source is initialized. This first value may be positive relative to the chamber 100, such as, for example, between 60 and 150V. This voltage may decrease over time. In one embodiment, there is a relationship between the voltage applied to electrode 130*a* and the hours of operation of the IHC ion source 10. This relationship may be linear, or may be any suitable function. For example, the voltage applied to electrode 130*a* may be changed after every 10 hours of operation.

Figure 4:
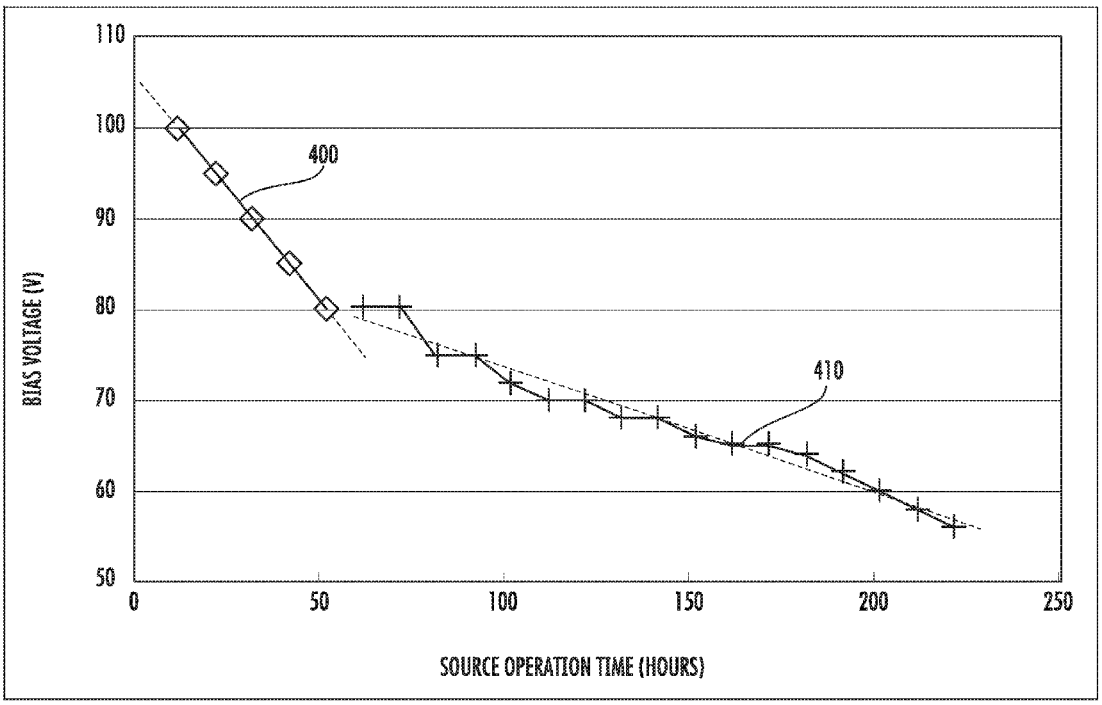
FIG. 4 shows a representative graph showing the relationship between bias voltage and hours of operation in one embodiment.

In a further embodiment, the controller 180 may further classify the operation of the ion source as either the burn-in phase or the operational phase. The burn-in phase may be considered, for example, the first 50 hours of operation, although other durations may also be used. The operational phase may be the hours of operation after the burn-in phase. The controller 180 may use one linear relationship between voltage and hours of operation during the burn-in phase and a second linear relationship between voltage and hours of operation during the operating phase. FIG. 4 shows a graph that represents this two phase approach. During the burn-in phase, denoted by line 400, the voltage may decrease at a first rate. During the operational phase, denoted by line 410, the voltage may decrease by a second rate. In some embodiments, the first rate is greater than the second rate.

In another embodiment, the controller 180 may monitor the actual extracted ion beam current and adjust the voltage applied to electrode 130*a*, using electrode power supply 135*a*. In certain embodiments, the voltage applied to the electrode 130*a* may decrease over time. For example, the voltage may be a first value when the ion source is initialized. This first value may be positive relative to the chamber 100, such as, for example, between 60 and 150V. To maintain a constant extracted ion beam current, the voltage may decrease over time.

In a particular embodiment, the voltage applied to the electrode 130*a* may be initially set to 80V. Over time, that voltage may decrease in order to maintain the target extracted ion beam current. In some embodiments, this decrease may be linear as a function of hours of operation. For example, the voltage of the electrode 130*a* may be defined as $V-m*H$, where V is the initial voltage applied to the electrode 130*a*, H is the number of hours of operation for the ion source and m is the rate at which the voltage is to be decreased with respect to hours of operation. In other embodiments, this decrease is determined by monitoring the extracted ions beam current and varying the voltage applied to electrode 130*a* to maintain the target extracted ion beam current. In this embodiment, the decrease in the voltage applied to the electrode 130*a* may or may not be linear over time.

Figure 2:
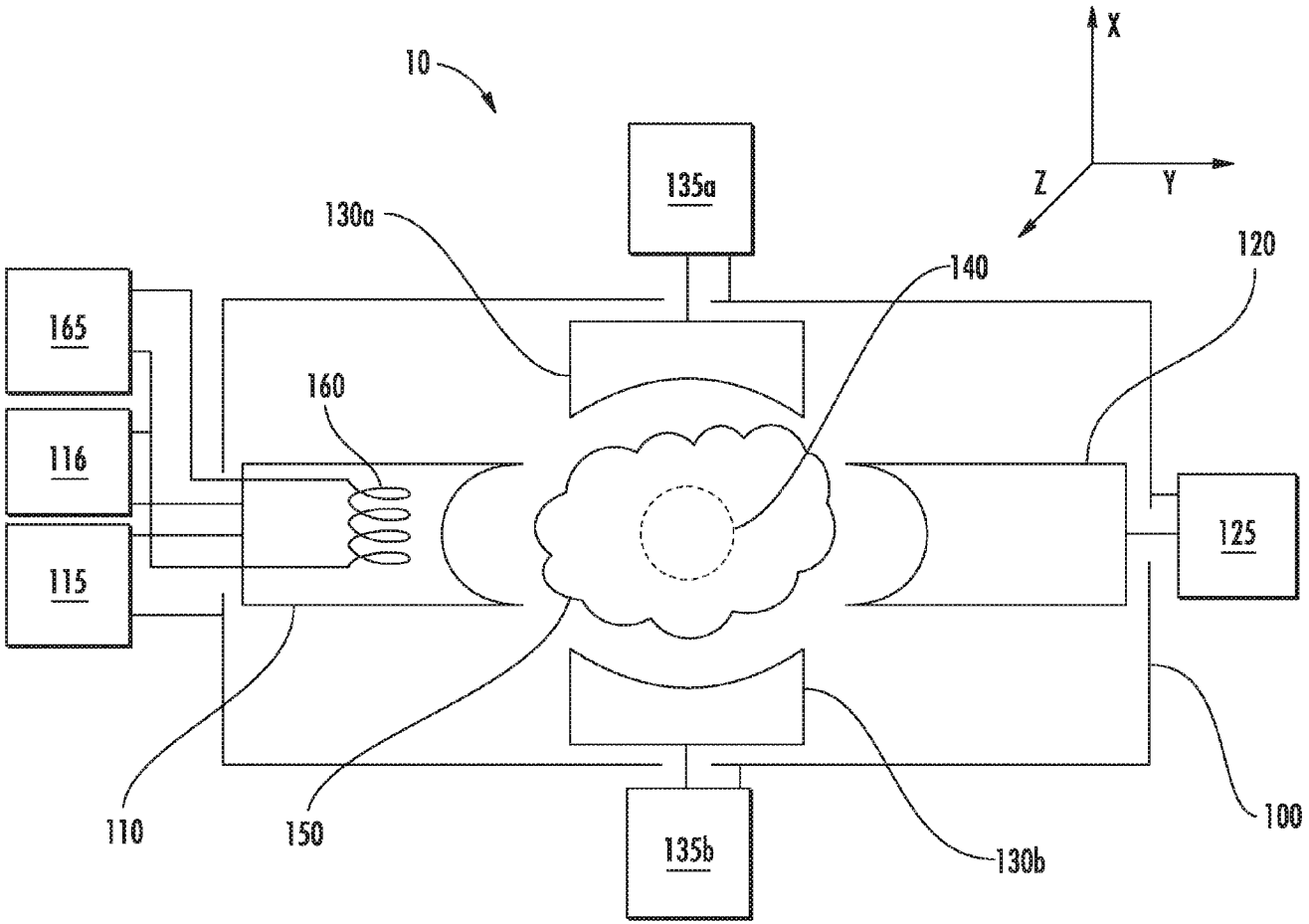
FIG. 2 shows the ion source of FIG. 1 after use and also represents an ion source according to another embodiment.

In certain embodiments, the initial shape of the cathode 110, repeller 120 and the electrodes 130*a*, 130*b* may be changed to improve the life of the IHC ion source 10. For example, typically, the front surfaces of these components are flat. However, in certain embodiments, these components may be initially formed with a front surface having a concave shape. While FIG. 2 shows the ion source of FIG. 1 after hours of operation, in another embodiment, the IHC ion source comprises components that are initially formed with a front surface having this concave shape. Thus, in another embodiment, FIG. 2 represents an IHC ion source having components that are initially formed with front surfaces having a concave shape. This concave shape may further help the increase the life of the IHC ion source 10.

The embodiments described above in the present application may have many advantages. As described above, IHC ion sources are susceptible to short life due to the sputtering effect on the cathode and the repeller. Unlike other IHC ion sources, the present system modifies the voltage applied to the cathode, repeller and/or electrodes over time to maintain a desired ion beam current. However, as the voltages applied to these components decreases, less sputtering occurs due to the reduced electrical potentials, increasing the life of the IHC ion source. In one test, the life of an IHC ion source was increased by over 40% using this technique.

In other words, prior art techniques seek to vary the temperature of cathode 110, which achieves the purpose of controlling the extracted ion beam current. However, none of these prior art techniques seeks to control the sputter rate of cathode 110, because the sputter rate primarily depends on the differential voltage between cathode 110, the repeller 120 and the other electrodes 130*a*, 130*b*. The present system maintains ion beam current, while simultaneously extending the life of the IHC ion source.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. An indirectly heated cathode ion source, comprising:
a chamber into which a gas is introduced;
a cathode disposed on one end of the chamber;
a repeller disposed at an opposite end of the chamber;
an electrode disposed along a side of the chamber; and
a second electrode on a side opposite the electrode, where the second electrode is electrically connected to the chamber,
wherein a voltage applied to at least one of the cathode, the repeller and the electrode relative to the chamber varies over time to maintain a desired ion beam current.

2. The indirectly heated cathode ion source of claim 1, wherein the voltage decreases over time.

3. The indirectly heated cathode ion source of claim 1, further comprising a controller, wherein the controller monitors hours of operation of the indirectly heated cathode ion source and determines the voltage to be applied based on hours of operation.

4. The indirectly heated cathode ion source of claim 1, further comprising a controller in communication with a current measurement system, wherein the measurement system measures current of an ion beam extracted from the indirectly heated cathode ion source through an extraction aperture, and the controller adjusts the voltage to be applied based on measured current of the ion beam.

5. The indirectly heated cathode ion source of claim 1, wherein the voltage is applied to the electrode.

6. The indirectly heated cathode ion source of claim 1, wherein at least one of the cathode, the repeller and the electrode is initially formed with a front surface having a concave surface.

7. An indirectly heated cathode ion source, comprising:
a chamber into which a gas is introduced;
a cathode disposed on one end of the chamber;
a repeller disposed at an opposite end of the chamber;
at least one electrode disposed along a side of the chamber; and
a controller, configured to determine a voltage to be applied to the at least electrode,
wherein the voltage applied to the at least one electrode decreases over time to maintain a desired ion beam current.

8. The indirectly heated cathode ion source of claim 7, wherein the controller monitors hours of operation of the indirectly heated cathode ion source and determines the voltage based on the hours of operation of the indirectly heated cathode ion source.

9. The indirectly heated cathode ion source of claim 8, wherein the controller decreases the voltage by a first rate during a burn-in phase and decreases the voltage by a second rate during an operational phase, wherein the first rate is greater than the second rate.

10. The indirectly heated cathode ion source of claim 7, wherein the controller is in communication with a current measurement system, wherein the measurement system measures a current of an ion beam extracted from the indirectly heated cathode ion source, and the controller adjusts the voltage based on measured current of the ion beam.

11. The indirectly heated cathode ion source of claim 7, further comprising a second electrode on a side opposite the at least one electrode, where the second electrode is electrically connected to the chamber.

12. The indirectly heated cathode ion source of claim 7, wherein at least one of the cathode, the repeller and the at least one electrode is initially formed with a front surface having a concave surface.

13. The indirectly heated cathode ion source of claim 7, wherein the cathode and the repeller are negatively biased relative to the chamber and the at least one electrode is initially positively biased relative to the chamber.

14. The indirectly heated cathode ion source of claim 13, wherein the voltage initially applied to the at least one electrode is between 60 and 150 volts.

15. An indirectly heated cathode ion source, comprising:
a chamber;
a cathode disposed on one end of the chamber, in communication with a cathode power supply;
a repeller disposed on an opposite end of the chamber, in communication with a repeller power supply;
an electrode disposed within the chamber and on a side of the chamber, in communication with an electrode power supply;
an extraction aperture disposed on another side of the chamber; and
a controller, in communication with at least one of the cathode power supply, the repeller power supply and the electrode power supply, wherein the controller modifies a voltage applied to one of the cathode, the repeller and the electrode relative to the chamber over time, and wherein the controller decreases the voltage by a first rate during a burn-in phase and decreases the voltage by a second rate during an operational phase, wherein the first rate is greater than the second rate.

16. The indirectly heated cathode ion source of claim 15, further comprising a second electrode disposed on a second side of the chamber, wherein the second electrode is in electrical contact with the chamber.

17. The indirectly heated cathode ion source of claim 15, wherein the cathode power supply and the repeller power supply are one power supply.

18. The indirectly heated cathode ion source of claim 15, wherein the controller varies the voltage as a function of hours of operation of the indirectly heated cathode ion source.

19. The indirectly heated cathode ion source of claim 15, wherein the voltage applied to the electrode is modified.

20. The indirectly heated cathode ion source of claim 15, wherein at least one of the cathode, the repeller and the electrode is initially formed with a front surface having a concave surface.

* * * * *